US006621710B1

(12) United States Patent
Cheng et al.

(10) Patent No.: US 6,621,710 B1
(45) Date of Patent: Sep. 16, 2003

(54) MODULAR PROBE CARD ASSEMBLY

(75) Inventors: Shih-Jye Cheng, Hsinchu (TW); An-Hong Liu, Tainan (TW); Yeong-Her Wang, Tainan (TW); Yuan-Ping Tseng, Hsinchu (TW); Yao-Jung Lee, Tainan (TW)

(73) Assignees: ChipMOS Technologies (Bermuda) Ltd., Hsinchu (TW); ChipMOS Technologies Inc., Hsinchu (TW)

( * ) Notice: Subject to any disclaimer, the term of this patent is extended or adjusted under 35 U.S.C. 154(b) by 0 days.

(21) Appl. No.: 10/198,118

(22) Filed: Jul. 19, 2002

(51) Int. Cl.[7] ..... H01R 9/00

(52) U.S. Cl. ..... 361/774; 361/785; 361/760; 361/720; 324/754; 324/762

(58) Field of Search ..... 361/774, 792, 361/760, 720, 736, 748, 719, 773, 785; 324/754, 757, 762, 758, 761

(56) References Cited

U.S. PATENT DOCUMENTS

| | | | | |
|---|---|---|---|---|
| 5,525,911 A | * | 6/1996 | Marumo et al. | 435/754 |
| 5,600,256 A | * | 2/1997 | Woith et al. | 324/754 |
| 6,344,752 B1 | | 2/2002 | Hagihara et al. | 324/754 |
| 6,359,456 B1 | * | 3/2002 | Hembree et al. | 324/754 |

* cited by examiner

*Primary Examiner*—David Martin
*Assistant Examiner*—Hung Bui
(74) *Attorney, Agent, or Firm*—Dennison, Schultz & Dougherty

(57) ABSTRACT

A modular probe card assembly comprises a silicon substrate with probes modularly assembled on a main board. At least a socket is installed around silicon substrate and electrically connects to probe needles by a flexible printed wiring film. A plurality of detachable coaxial wires electrically connect sockets with the main board for achieving variability of connecting paths during manufacturing. Thus, the probe card assembly has the effect of adjustable amendment and is suitable for high speed testing.

1 Claim, 4 Drawing Sheets

MODULAR PROBE CARD ASSEMBLY

FIELD OF THE INVENTION

The present invention relates to a probe card for semiconductors, particularly to a probe card with modular assembly configuration.

BACKGROUND OF THE INVENTION

A conventional test apparatus for the semiconductor wafers comprises a probe card setup in a test head of a tester. The probe card has numerous probe needles in contact with the bonding pads or bumps on a wafer to provide electrical connection for wafer-level testing.

U.S. Pat. No. 6,344,752 entitled "CONTACTOR AND PRODUCTION METHOD FOR CONTRACTOR" as shown is FIG. 4, referred to a probe card performs electrical testing of a wafer. It has a plurality of first electrodes 3 arranged on a silicon substrate 2 and probe terminals 4 respectively provided on these electrodes 3. Second electrodes 5 are provided on the rear surface of the silicon substrate 2. The first electrode 3 and second electrode 5 are electrically connected to each other by a connection via 6. The second electrodes 5 on the silicon substrate 2 have elastic connection members 10 mounted on the third electrodes 11A on the printed wiring board 11. Both of the silicon substrate 2 and the wafer under test are made of silicon, therefore there is no difference in thermal expansion coefficient, and can perform electrical contact precisely. To perform this, a connection via 6 has to be manufactured and installed to connect the upper and lower surfaces of the silicon substrate 2, and thus raised the problem of a higher degree of brokenness of the connection line and broken wafers. Besides, the substance of the elastic connection members 10 connecting the silicon substrate 2 and the printed wiring board 11 has to be metal. It provides not only elastic machinery connection, but also performs as an electrical connector between the silicon substrate 2 and the printed wiring board 11. Mechanics fatigue or brokenness among any one of the elastic connection members 10 will fail the electrical connection of the probe card. Besides, the silicon substrate 2 mounted on the probe card was jointly fastened on the printed wiring board 11, and did not have the detachable virtue of modular exchange.

SUMMARY OF THE INVENTION

A main purpose of the present invention is to supply a modular probe card in utilizing of a silicon substrate modularly assembled on a main board. The silicon substrate and the multi-layer printed circuit board are electrically connected by a flexible printed wiring film and coaxial wires. It is easy to manufacture the silicon substrate and have the detachable virtue of modular exchange according to the present invention.

The second purpose of the present invention is to supply a modular probe card comprising a silicon substrate assembled on a main board with sockets installed around. A plurality of detachable coaxial wires are connected to sockets on the main board for achieving variability of connecting paths during manufacturing. Thus, the probe card assembly has the effect of adjustable amendment and is suitable for high speed testing.

In accordance with the present invention, a modular probe card comprises a modular silicon substrate with first and second surfaces, assembled on a main board. It is preferable that a plurality of connecting pads and electric circuits connecting through those connecting pads are arranged on the first surface of the silicon substrate, and a stress buffer is provided on the second surface of the silicon substrate. At least a socket is installed on the main board, and a flexible printed wiring film connects through the silicon substrate and the socket. A plurality of detachable coaxial wires are connected to the socket with the main board for achieving variability of connecting paths during manufacturing, and this is suitable for high speed testing. It is preferable that these coaxial connecting wires are in the same length to avoid signal time delay.

DETAIL DESCRIPTION OF THE INVENTION

Please refer to the attached drawings, the present invention will be described by means of an embodiment below.

Figure 1:
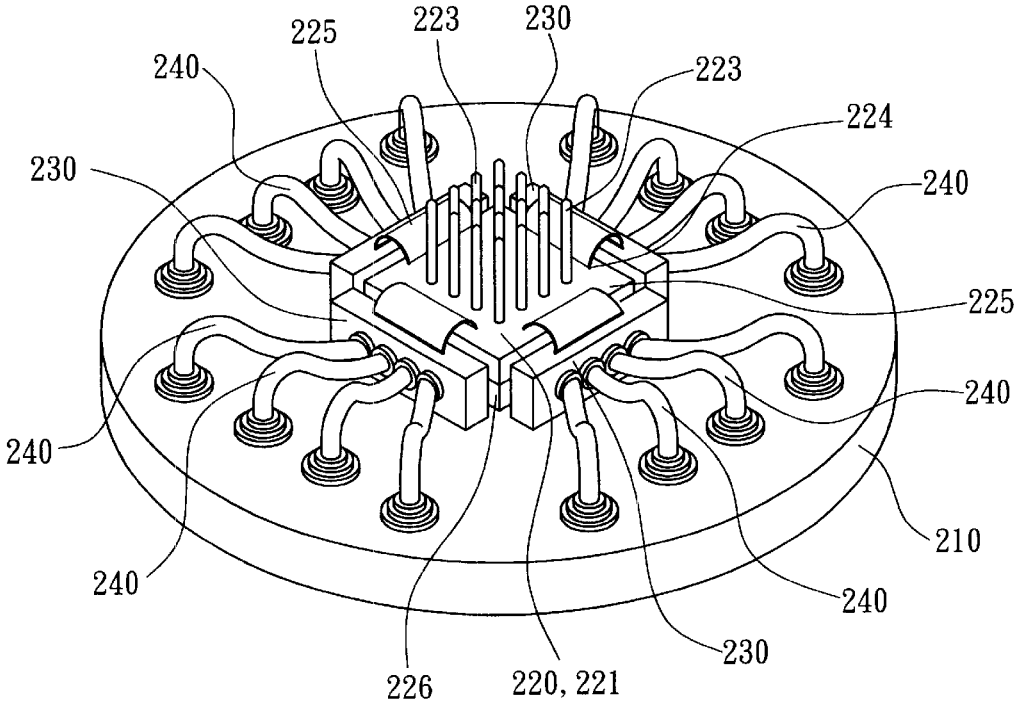
FIG. 1 is a three-dimensional layout of a modular probe card assembly according to the present invention.
Figure 3:
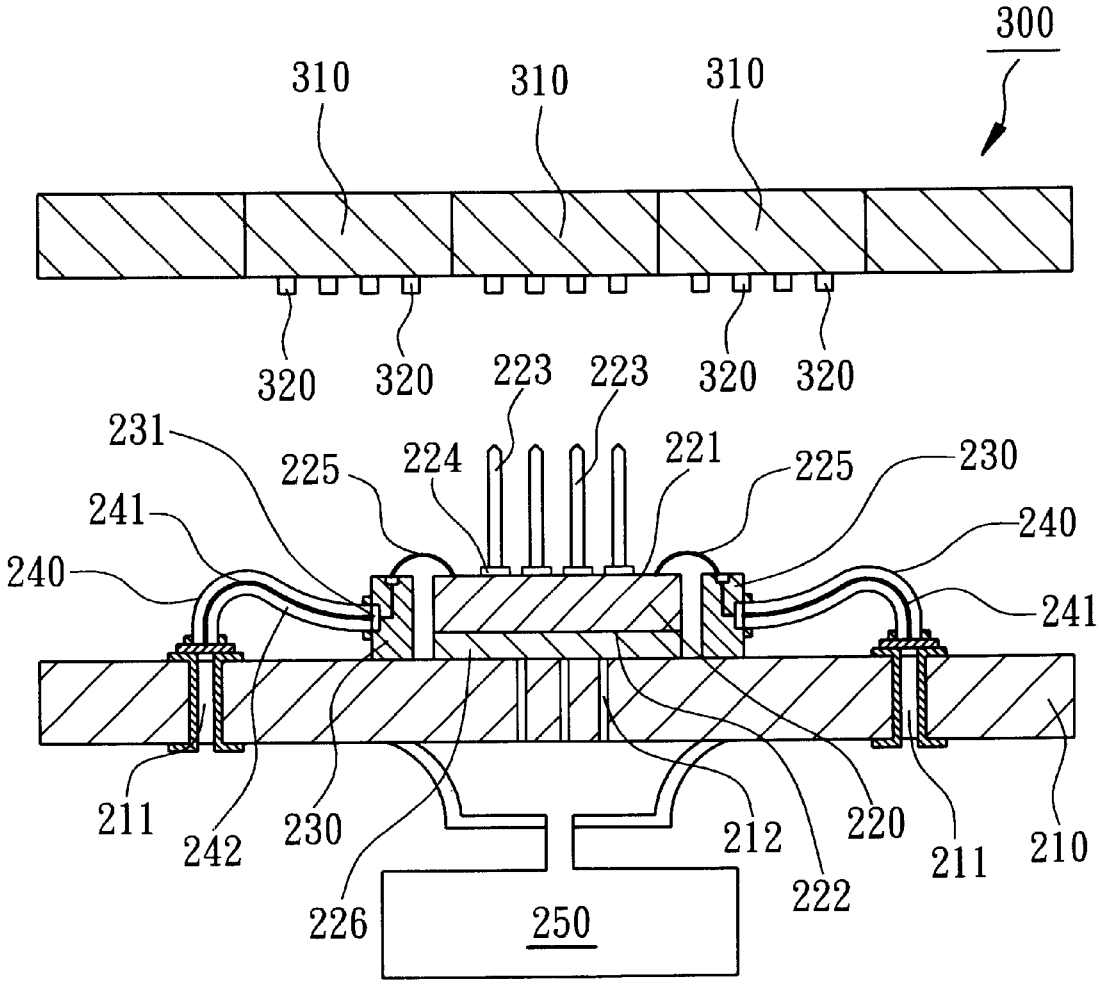
FIG. 3 is a cross-sectional view of the modular probe card assembly according to the present invention.
Figure 4:
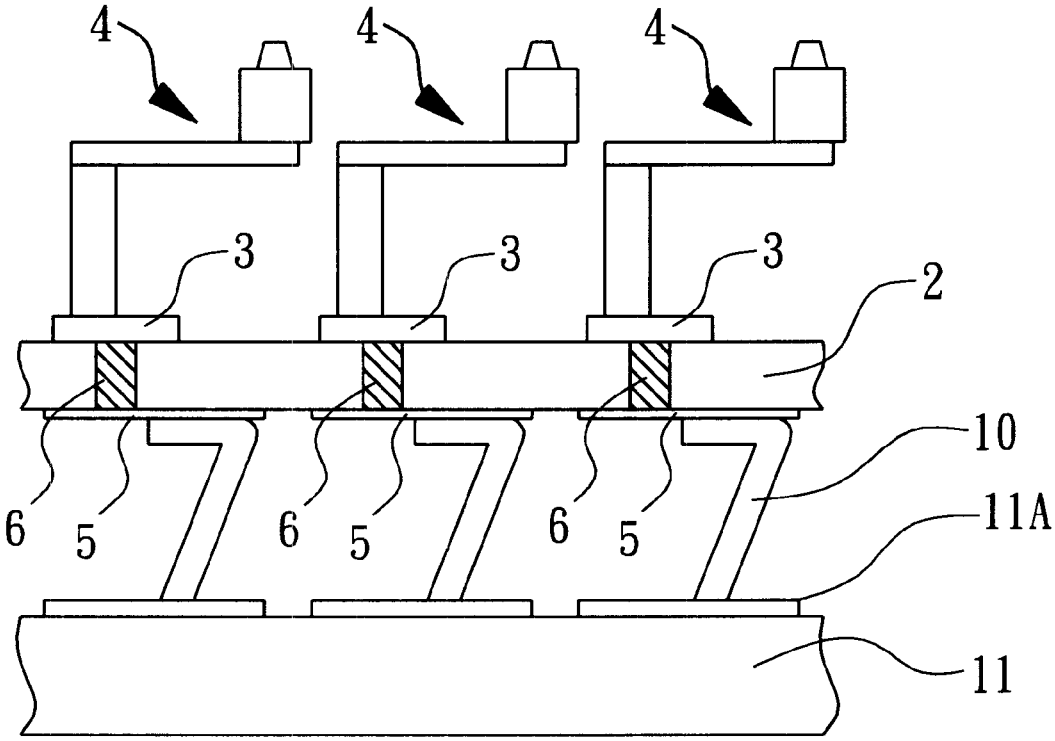
FIG 4 PRIOR ART
FIG. 4 is a cross-sectional view of a probe card according to the U.S. Pat. No. 6,344,752 entitled "CONTACTOR AND PRODUCTION METHOD FOR CONTRACTOR".

As shown in FIG. 1 and 3, the modular probe card comprises: a main board 210 and a silicon substrate 220, wherein the main board 210 is for bearing the weight of the silicon substrate 220 and for the electrical interface to a tester. In this embodiment, the main board 210 is made of glass fiber reinforced resin, having a plurality of via holes 211 and a vacuum hole 212. An air pump 250 is used to extract air directly from the vacuum hole 212, and this will hold the silicon substrate 220 on the main board 210 during operation; or, the main board 210 could also be made of a multi-layer printed circuit board, and the silicon substrate 220 performs as a probe head of the modular probe card assembly to contact the wafer 300 under test (as shown in FIG. 3).

Figure 2:
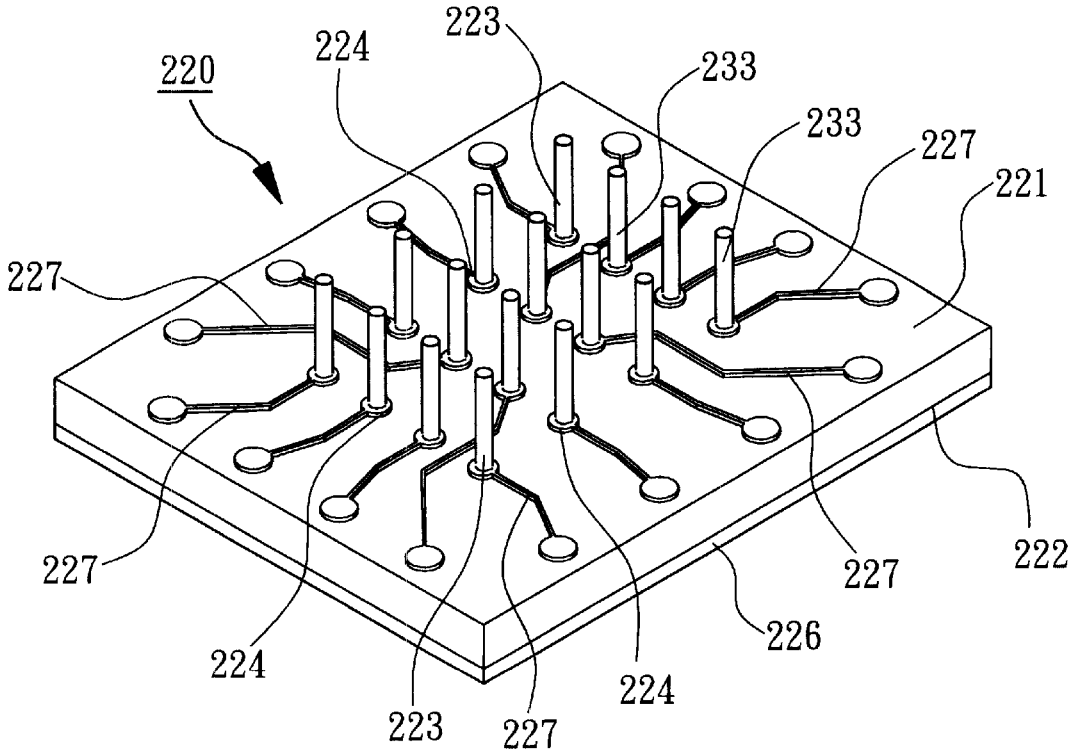
FIG. 2 is a three-dimensional layout of a silicon substrate of the modular probe card assembly according to the present invention.

As shown in FIG. 2, the silicon substrate 220 has a first surface 221 and a second surface 222, wherein probe needles 223 are arranged on the first surface 221 to contact the wafer 300 under test (As shown in FIG. 3). In the embodiment, a plurality of electrode pads 224 and connecting circuits 227 which connect those electrode pads 224 are arranged on;the first surface 221. The probe needles 223 are to be made on the electrode pads 224. Those connecting circuits 227 make their way to the edges of the first surface 221 of the silicon substrate 220. The silicon substrate 220 assembles with the main board 210 with the second surface 222 facing toward it. In another embodiment, the silicon board 220 is a chip with Micro-Electro-Mechanical components, such as microwave probe, micro sensor, micro actuator, micro resistor, micro capacitors, or integrated circuits. The silicon substrate 220 has a circuit layer to electrically connect the probe needles 223 to the edges of the first surface 221. Further, it is preferable that the second surface 222 of the silicon substrate 220 is formed with a stress buffer layer 226. It is a material with thermnal expansion coefficient between the silicon substrate 220 and the main board 210, or something like rubber or silicone, to protect silicon substrate 220 at different operating temperatures.

A plurality of sockets 230 are installed around the silicon substrate 220 which assembled on the, main board 210, and keep electrical connection with the probe needles 223 on the silicon substrate 220. In this embodiment, at least a flexible printed wiring film 225 is used to electrically connect the silicon substrate 220 and sockets 230. The flexible printed wiring film 225 connecting the sockets .230 is detachable from the silicon substrate 220 for the purpose of modular assembling. When another wafer 300, with various bonding pads 320 layout, is under test, it needs only to change the corresponding silicon substrate 220. Furthermore, there are assemble hole 231 formed on a surface of each socket 230 to connect with coaxial wires 240.

A plurality of the coaxial wire 240 provide electrical connection to the main board 210 and the sockets 230, with one end connecting to the corresponding assemble hole 231 on the sockets 230, and the other end to the corresponding via holes 211 on the main board 210. The plurality of the coaxial wires 240 are conductive wires 241, such as copper wires, with dielectric shrouds 242 wrapped on the external diameter to avoid the cross-talk between the coaxial wires 240. It is preferable that the plurality of the coaxial wires 240 be in the same length to well control the signal time delay.

As shown in FIG. 3, when use the modular probe card assembly to conduct electrical contact with a wafer 300, the wafer 300 is formed with several chips 310, each chip 310 having bonding pads 320. The probe needles 223 on silicon substrate 220 will contact the bonding pads 320 on chips 310 to provide electrical connection for chip-probing and wafer-level testing.

The coaxial wires 240 described above are detachable during manufacturing. They will connect to the main board 210 and sockets 230 in the first place to conduct measure and adjustment. The coaxial wires 240 can be replaced in part if any mistake in electrical connection or delay in electrical transmission is found. After readjustment, the connection points of those coaxial connecting wires 240 will then be fixed. Thus, the every transmission path of the modular probe card assembly will have the same impedance for high-speed, high-parallel testing and/or burn-in; low yield problem during manufacturing, thus, can be avoided. If any mistake is found in the coaxial connecting wires 240, socket 230, or silicon substrate 220, it can be replaced directly, without discarding the whole modular probe card.

Besides, the silicon substrate 220 manufactured according to the present invention is modularly assembled on main board 210. When wafers with the same electrical function yet patterned with different bonding pads/ bumps layout or when probe needles 223 are contaminated or damaged, it is not necessary that the whole probe card be replaced. It needs only to replace with a silicon substrate 220 patterned according to the bonding pads 320 on the wafers. This characteristic enhances the applications of probe cards.

The above description of embodiments of this invention is intended to be illustrative and not limiting. Other embodiments of this invention will be obvious to those skilled in the art in view of the above disclosure.

What is claimed is:

1. A modular probe card assembly comprising:

a silica substrate having first and second surfaces and a plurality of probe needles formed on said first surface and wherein said second surface of said silica substrate is formed with a stress buffer layer;

a glass fiber reinforced resin main board having a plurality of sockets thereon, a plurality of via holes therein and a vacuum hole for holding the silica substrate on said main board;

a flexible printed wiring film electrically connecting said sockets and said probe needles;

a plurality of coaxial copper wires with dielectric shrouds rapped on the external diameter to avoid cross talk and wherein the coaxial wires are of the same length to control the signal time delay; and wherein the modular card assembly further comprises a plurality of electrode pads and connecting circuits arranged on said first surface of the silicon substrate, and wherein the probe needles are bonded on the electrode pads, and said connecting circuits electrically connect the electrode pads and extend to the edges of the first surface of the silicon substrate.

* * * * *

UNITED STATES PATENT AND TRADEMARK OFFICE

CERTIFICATE OF CORRECTION

PATENT NO. : 6,621,710 B1 
DATED : September 16, 2003
INVENTOR(S) : Shih-Jye Cheng et al.

It is certified that error appears in the above-identified patent and that said Letters Patent is hereby corrected as shown below:

Title page,
Item [73], Assignees, please change the first Assignee's city and country as follows:
-- ChipMOS Technologies (Bermuda) Ltd., Hamilton HM 12, Bermuda --

Signed and Sealed this

Twentieth Day of January, 2004

JON W. DUDAS
*Acting Director of the United States Patent and Trademark Office*